US008710729B2

(12) United States Patent
Tang et al.

(10) Patent No.: US 8,710,729 B2
(45) Date of Patent: Apr. 29, 2014

(54) FIELD EMISSION CATHODE DEVICE AND FIELD EMISSION DISPLAY USING THE SAME

(75) Inventors: Jie Tang, Beijing (CN); Bing-Chu Du, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 247 days.

(21) Appl. No.: 13/081,340

(22) Filed: Apr. 6, 2011

(65) Prior Publication Data

US 2012/0153802 A1 Jun. 21, 2012

(30) Foreign Application Priority Data

Dec. 15, 2010 (CN) ..... 2010 1 0589777

(51) Int. Cl.
*H01J 1/304* (2006.01)
*H01J 31/12* (2006.01)

(52) U.S. Cl.
USPC ..... 313/497; 313/496; 313/310

(58) Field of Classification Search
USPC ..... 313/495–497, 310
See application file for complete search history.

(56) References Cited

U.S. PATENT DOCUMENTS

| | | | | |
|---|---|---|---|---|
| 2004/0217382 | A1 | 11/2004 | Konuma | |
| 2005/0218789 | A1 * | 10/2005 | Seon | 313/497 |
| 2005/0258729 | A1 | 11/2005 | Han et al. | |

FOREIGN PATENT DOCUMENTS

| | | | |
|---|---|---|---|
| CN | 1700400 | A | 11/2005 |
| CN | 10177479 | | 7/2010 |
| JP | 2001-43789 | | 2/2001 |
| JP | 2002-100279 | | 4/2002 |
| JP | 2003-45315 | | 2/2003 |
| JP | 2003-263951 | | 9/2003 |
| JP | 2005-340193 | | 12/2005 |
| JP | 2008-112609 | | 5/2008 |

* cited by examiner

*Primary Examiner* — Karabi Guharay
(74) *Attorney, Agent, or Firm* — Novak Druce Connolly Bove + Quigg LLP

(57) ABSTRACT

A field emission cathode device includes a cathode substrate, a gate electrode, a first dielectric layer, a cathode electrode, and an electron emission layer. The gate electrode is located on a surface of the cathode substrate. The first dielectric layer is located on a surface of the gate electrode and defines a first opening to expose part of the gate electrode. The cathode electrode is spaced from the gate electrode through the first dielectric layer defining a second opening in alignment with the first opening. A field emission display using the field emission cathode device is also related.

16 Claims, 8 Drawing Sheets

FIELD EMISSION CATHODE DEVICE AND FIELD EMISSION DISPLAY USING THE SAME

RELATED APPLICATIONS

This application claims all benefits accruing under 35 U.S.C. §119 from China Patent Application No. 201010589777.8, filed on Dec. 15, 2010 in the China Intellectual Property Office, the contents of which are hereby incorporated by reference.

BACKGROUND

1. Technical Field

The present disclosure relates to a back-gate field emission cathode device and a field emission display using the same.

2. Description of Related Art

Field emission displays (FEDs) are a new, rapidly developing flat panel display technology. A back-gate field emission display is easy to fabricate and attracting more and more attention.

A Back-gate field emission display is disclosed by Chinese patent publication (Title: "A PRINTING TYPE FIELD EMISSION DISPLAY AND A MAKING METHOD THEREOF"; Publication Number: CN101777479; Publication Date: Jul. 14, 2001). The back-gate field emission display includes a glass substrate, a gate electrode, a number of dielectric layers, a number of cathode electrodes, a number of electron emitters, an indium tin oxide (ITO) substrate, a black matrix, and a number of fluorescent layers. However, in use, the electric field of the gate electrode can reach the surface of the electron emitter only from the periphery of the cathode electrode. Therefore, electrons can be emitted mainly from the edge of the electron emitter that causes a nonuniform pixel dot image.

What is needed, therefore, is a back-gate field emission display that can overcome the above-described shortcomings.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

References will now be made to the drawings to describe, in detail, various embodiments of the present back-gate field emission cathode device and the field emission display using the same. The field emission display can include a single pixel unit or a number of pixel units to form an array. In following embodiments, a field emission display including a single pixel unit and a field emission display including a number of pixel units are respectively provided and described as example.

Figure 1:
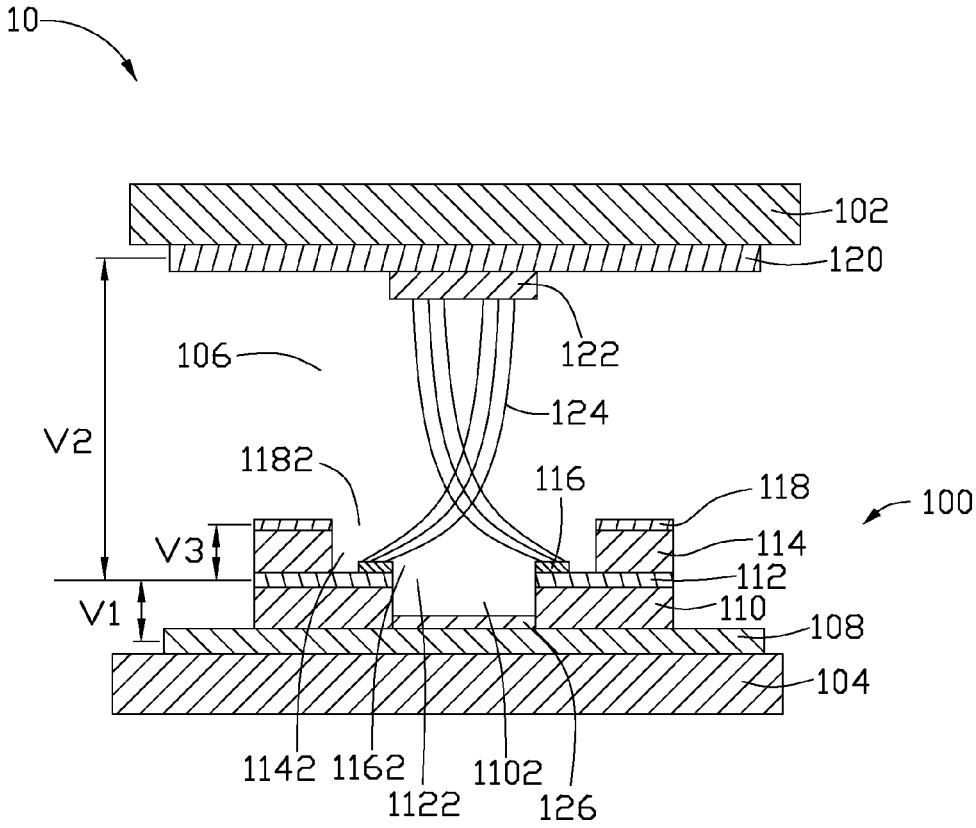
FIG. 1 is a schematic view of one embodiment of a pixel unit of a field emission display.

Referring to FIG. 1, a field emission display 10 of one embodiment includes a cathode substrate 104, a gate electrode 108, a first dielectric layer 110, a cathode electrode 112, an electron emission layer 116, a second dielectric layer 114, a focus electrode 118, an anode substrate 102, an anode electrode 120, and a fluorescent layer 122. The cathode substrate 104, the gate electrode 108, the first dielectric layer 110, the cathode electrode 112, the electron emission layer 116, and the focus electrode 118 together form a back-gate field emission cathode device 100.

The anode substrate 102 and the cathode substrate 104 are spaced from each other to define a vacuum space 106. The gate electrode 108, the first dielectric layer 110, the cathode electrode 112, the electron emission layer 116, the focus electrode 118, the anode electrode 120, and the fluorescent layer 122 are accommodated in the vacuum space 106. The gate electrode 108 is located on a surface of the cathode substrate 104. The first dielectric layer 110 is located on a surface of the gate electrode 108. The first dielectric layer 110 defines a first opening 1102 such that part of the gate electrode 108 is exposed. The cathode electrode 112 is located on a surface of the first dielectric layer 110 and spaced from the gate electrode 108 by the first dielectric layer 110. The cathode electrode 112 defines a second opening 1122 in alignment with the first opening 1102. The electron emission layer 116 is located on a surface of the cathode electrode 112, electrically connected to the cathode electrode 112. In one embodiment, the electron emission layer 116 is located adjacent to the second opening 1122 and spaced from the second dielectric layer 114. The electron emission layer 116 defines a third opening 1162 linked with the second opening 1122. The anode electrode 120 is located on a surface of the anode substrate 102. The fluorescent layer 122 is located on a surface of the anode electrode 120. The focus electrode 118 is located between the cathode electrode 112 and the anode electrode 120. The focus electrode 118 defines a fourth opening 1182 having a diameter larger than that of the third opening 1162 to expose part of the cathode electrode 112 and the electron emission layer 116.

The cathode substrate 104 can be made of insulative material. The insulative material can be ceramics, glass, resins, quartz, or polymer. The size, shape, and thickness of the cathode substrate 104 can be chosen according to need. The cathode substrate 104 can be a square plate, a round plate or a rectangular plate. In one embodiment, the cathode substrate 104 is a square glass plate.

The gate electrode 108 is a conductive layer. The size, shape and thickness of the gate electrode 108 can be chosen according to need. The gate electrode 108 can be located on a surface of the cathode substrate 104. At least part of the gate electrode 108 is exposed through the first opening 1102. The gate electrode 108 can be made of metal, alloy, conductive slurry, or ITO. The metal can be copper, aluminum, gold, silver, or iron. The conductive slurry can include metal powder of about 50% to about 90% by weight, glass powder of about 2% to about 10% by weight, and binder of about 8% to about 40% by weight. If the cathode substrate 104 is a silicon wafer, the gate electrode 108 can be a doped layer. In one embodiment, the gate electrode 108 is an aluminum film with a thickness of about 20 micrometers. The gate electrode 108 can be deposited on the surface of the cathode substrate 104 by sputtering.

The first dielectric layer 110 is located between the cathode electrode 112 and the gate electrode 108. The first dielectric layer 110 can be made of resin, glass, ceramic, oxide, photosensitive emulsion, or combination thereof. The oxide can be silicon dioxide, aluminum oxide, or bismuth oxide. The size, shape and thickness of the first dielectric layer 110 can be chosen according to need. The first dielectric layer 110 can be located on the cathode substrate 104 or on the gate electrode 108. The first opening 1102 allows the electrons 124, moving toward the gate electrode 108, to be captured by the gate electrode 108 and to be conducted by the gate electrode 108. In one embodiment, the first dielectric layer 110 is a ring-shaped SU-8 photosensitive emulsion with a thickness of about 100 micrometers.

The cathode electrode 112 can be a conductive layer or a conductive plate. The size, shape, and thickness of the cathode electrode 112 can be chosen according to need. The cathode electrode 112 can be made of metal, alloy, conductive slurry, or ITO. The electric field of the gate electrode 108 can get through the second opening 1122 and reach the surface of the electron emission layer 116. In one embodiment, the cathode electrode 112 is an aluminum layer. The second opening 1122 and the first opening 1102 are coaxial and have the same diameter.

Figure 2:
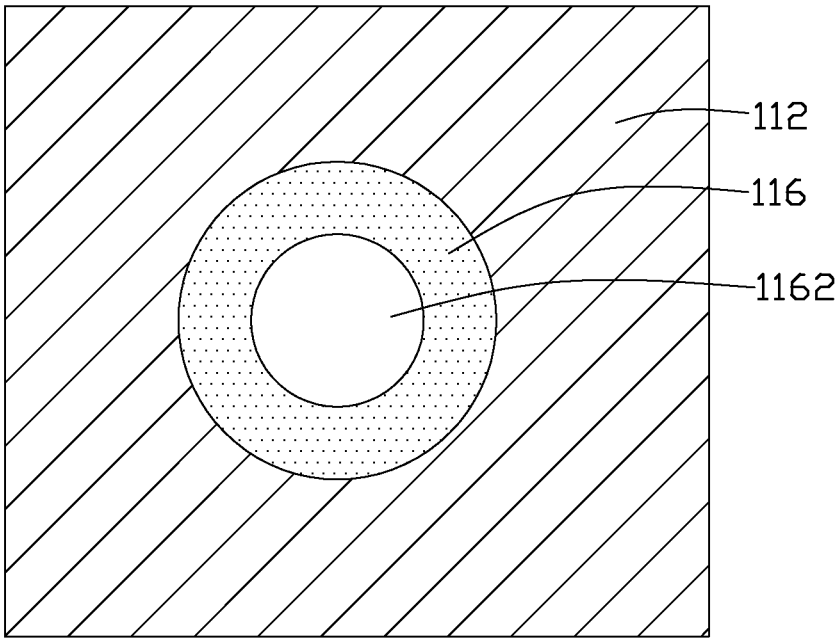
FIG. 2 shows a cathode and an electron emission layer of the field emission display of FIG. 1.

Further referring to FIG. 2, the electron emission layer 116 is located adjacent to the second opening 1122 so that the electric field of the gate electrode 108 can reach the entire surface of the electron emission layer 116 from the second opening 1122. The electron emission layer 116 can be located on part of or the entire exposed surface of the cathode electrode 112. In one embodiment, the third opening 1162, the second opening 1122 and the first opening 1102 are coaxial and have the same diameter.

The electron emission layer 116 can include a number of electron emitters such as carbon nanotubes, carbon nanofibres, or silicon nanowires. Each of the electron emitters has an electron emission tip. The electron emission tip points towards the fluorescent layer 122. The size, shape, and thickness of the electron emission layer 116 can be chosen according to need. Furthermore, the electron emission layer 116 can be coated with a protective layer (not shown). The protective layer can be made of anti-ion bombardment materials such as zirconium carbide, hafnium carbide, and lanthanum hexaborid. The protective layer can be coated on a surface of each of the electron emitters. The electron emission layer 116 can be comprised of a number of carbon nanotubes and a glass layer. The carbon nanotubes are electrically connected to the cathode electrode 112. The glass layer fixes the carbon nanotubes on the cathode electrode 112. The electron emission layer 116 is formed by heating a carbon nanotube slurry layer. The carbon nanotube slurry layer includes a number of carbon nanotubes, a glass powder, and an organic carrier. The organic carrier is volatilized during the heating process. The glass powder is melted and solidified to form a glass layer to fix the carbon nanotubes on the cathode electrode 112 during the heating and cooling process.

The focus electrode 118 can be a metal mesh, metal sheet, ITO film, or conductive slurry layer. The focus electrode 118 is located between the cathode electrode 112 and the anode electrode 120. The focus electrode 118 can be spaced from the cathode electrode 112 by the second dielectric layer 114 or suspended above the cathode electrode 112. The material of the second dielectric layer 114 can be same as the first dielectric layer 110. The second dielectric layer 114 can define a fifth opening 1142 in alignment with the fourth opening 1182 to expose part of the cathode electrode 112 and the electron emission layer 116. In one embodiment, the fifth opening 1142 and the fourth opening 1182 are coaxial and have the same diameter.

The anode substrate 102 is a transparent plate. The thickness, size and shape of the anode substrate 102 can be selected according to need. In one embodiment, the anode substrate 102 is a rectangular plate. The anode substrate 102 and the cathode substrate 104 can be sealed by an insulative bar to form the vacuum space 106. In one embodiment, the anode substrate 102 is a square glass plate.

The anode electrode 120 is a transparent conductive layer such as carbon nanotube film, ITO film or aluminum film. The thickness, size and shape of the anode electrode 120 can be selected according to need. In one embodiment, the anode electrode 120 is an ITO film with a thickness of 100 micrometers.

The fluorescent layer 122 can be located on the anode electrode 120 or between the anode electrode 120 and the anode substrate 102. The thickness, size and shape of the fluorescent layer 122 can be selected according to need. The fluorescent layer 122 can be round. The diameter of the fluorescent layer 122 can be greater than or equal to the inner diameter of the electron emission layer 116 and less than or equal to the outer diameter of the electron emission layer 116. In one embodiment, the fluorescent layer 122 is round and has a diameter equal to the outer diameter of the electron emission layer 116.

Furthermore, the field emission display 10 can include a secondary electron emission layer 126 located on a surface of the gate electrode 108. The secondary electron emission layer 126 can be made of magnesium oxide (MgO), beryllium oxide (BeO), magnesium fluoride ($MgF_2$), beryllium fluoride ($BeF_2$), cesium oxide (CsO), barium oxide (BaO), silver oxygen cesium (Ag—O—Cs), antimony-cesium alloy, silver-magnesium alloy, nickel-beryllium alloy, copper-beryllium alloy, aluminum-magnesium alloy, or GaP(Cs). The size, shape, and thickness of the secondary electron emission layer 126 can be chosen according to need. The secondary electron emission layer 126 can be formed by coating, electron beam evaporation, thermal evaporation or magnetron sputtering. The secondary electron emission layer 126 can have a curved surface or a concave-convex structure. In one embodiment, the secondary electron emission layer 126 is a round BaO film with a thickness of about 5 micrometers.

In use, the cathode electrode 112 is grounded, a positive voltage V1 is supplied to the gate electrode 108, a positive voltage V2 is supplied to the anode electrode 120, a negative voltage V3 is supplied to the focus electrode 118. The V1 of the gate electrode 108 can be in a range from about 10 volts to about 100 volts. The V2 of the anode electrode 120 can be in a range from about 500 volts to about 5000 volts. The V3 of the focus electrode 118 can be in a range from about −5 volts to about −50 volts. The electric field of the gate electrode 108 can reach the surface of the electron emission layer 116 from the second opening 1122 such that the electron emission layer 116 emits the electrons 124. The focus electrode 118 with negative voltage can focus the electron 124 to form an electron beam.

Figure 3:
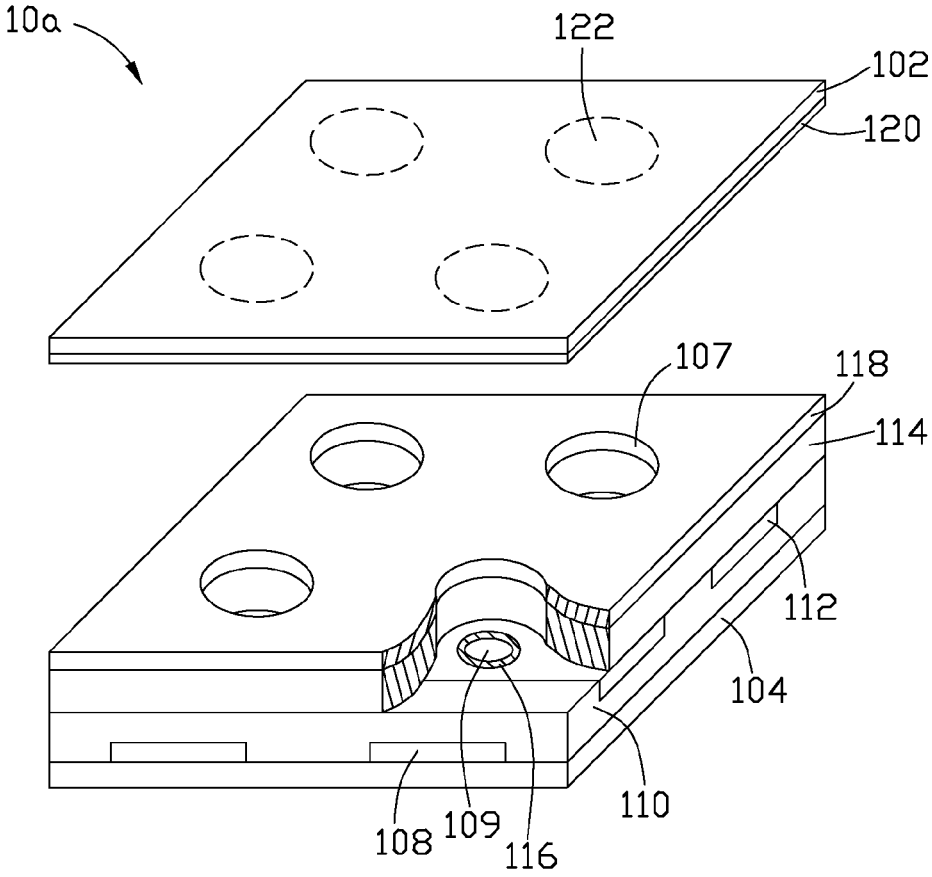
FIG. 3 is a three-dimensional schematic view of one embodiment of a field emission display including a number of pixel units of FIG. 1.

Referring to FIG. 3, a field emission display 10*a* having a number of pixel units, of one embodiment, comprises a common cathode substrate 104, a number of strip-shaped gate electrodes 108, a common first dielectric layer 110, a number of strip-shaped cathode electrodes 112, a number of ring-shaped electron emission layers 116, a common second dielectric layer 114, a common focus electrode 118, a common anode substrate 102, a common anode electrode 120, and a number of round fluorescent layers 122.

The strip-shaped gate electrodes 108 are located on the cathode substrate 104 parallel and uniformly spaced with each other. The first dielectric layer 110 is located on the strip-shaped gate electrodes 108. The strip-shaped cathode electrodes 112 are located on the first dielectric layer 110 parallel and uniformly spaced with each other. The strip-shaped cathode electrodes 112 are vertical to the strip-shaped gate electrodes 108. The intersection where each strip-shaped cathode electrodes 112 cross with each strip-shaped gate electrodes 108 defines a pixel unit. A first through hole 109 is formed to get through the first dielectric layer 110 and the strip-shaped cathode electrode 112 corresponding to each pixel unit. The second dielectric layer 114 is located on the strip-shaped cathode electrodes 112. The focus electrode 118 is a continuous layer and located on the second dielectric layer 114. An second through hole 107 is formed to get through the focus electrode 118 and the second dielectric layer 114 corresponding to each pixel unit to expose part of the strip-shaped cathode electrodes 112. Each ring-shaped electron emission layer 116 is located on the exposed part of the strip-shaped cathode electrodes 112 and corresponding to one pixel unit. The anode electrode 120 is a transparent conductive layer covered on entire anode substrate 102. Each round fluorescent layer 122 is located on the anode electrode 120 and corresponds to one pixel unit. Furthermore, a black matrix can be located among the round fluorescent layers 122 to enhance the contrast of the field emission display 10.

Figure 4:
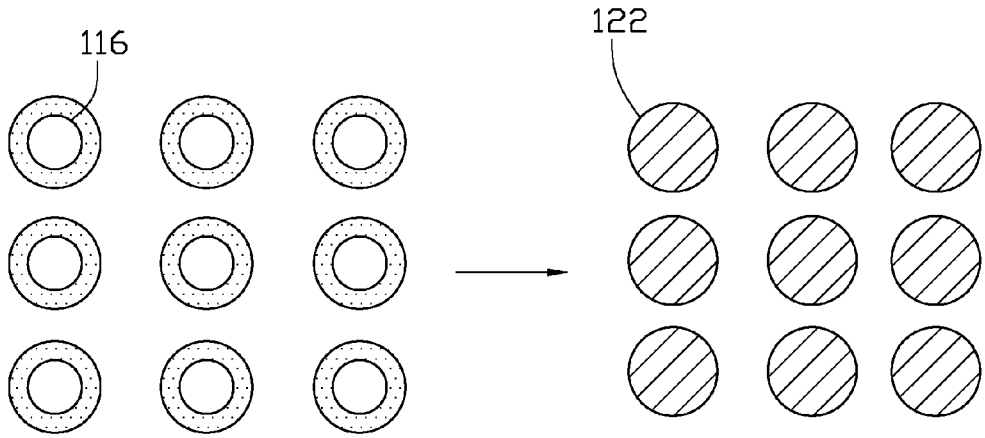
FIG. 4 shows a shape of electron emission layers and a shape of pixel unit images of one embodiment of a field emission display.

Referring to FIG. 4, a shape of electron emission layers 116 and a shape of pixel unit images of the fluorescent layers 122 are shown. The electron emission layers 116 are ring-shaped and the pixel unit images of the fluorescent layers 122 are uniform and round-shaped.

Figure 5:
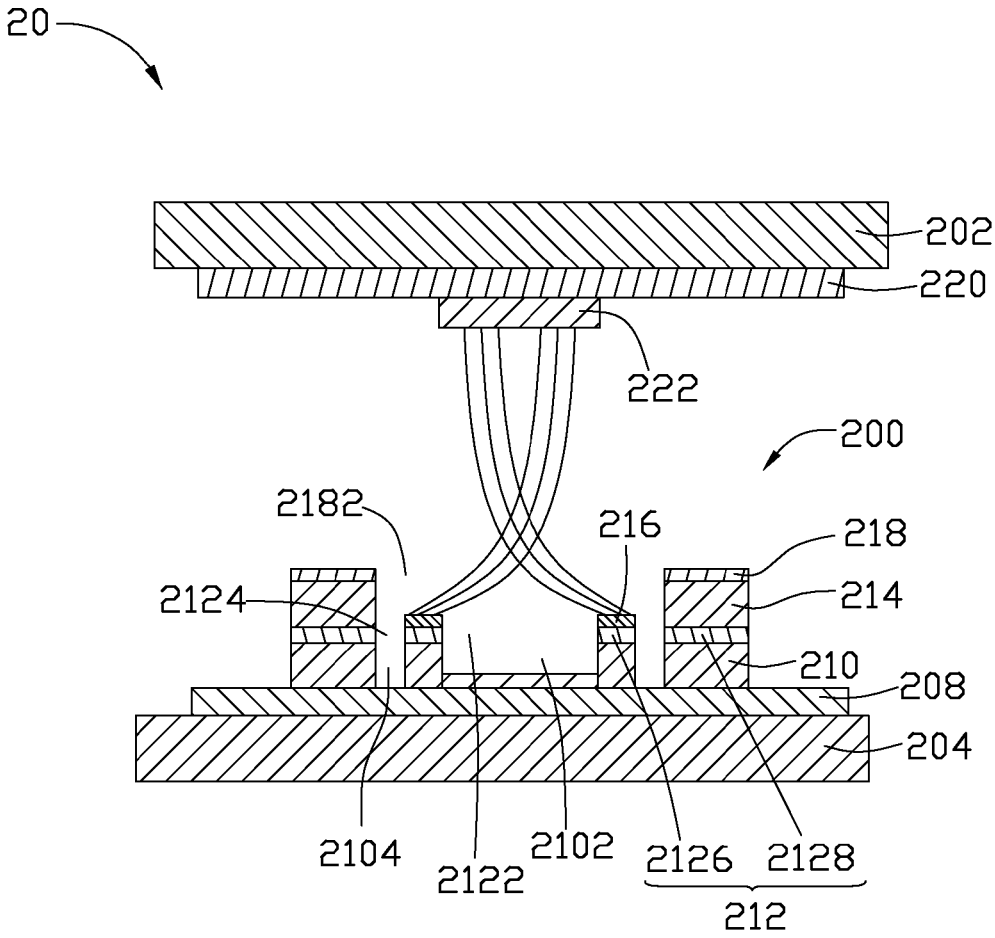
FIG. 5 is a schematic view of one embodiment of a pixel unit of a field emission display.

Referring to FIG. 5, a field emission display 20 of one embodiment includes a cathode substrate 204, a gate electrode 208, a first dielectric layer 210, a cathode electrode 212, an electron emission layer 216, a second dielectric layer 214, a focus electrode 218, an anode substrate 202, an anode electrode 220, and a fluorescent layer 222. The cathode substrate 204, the gate electrode 208, the first dielectric layer 210, the cathode electrode 212, the electron emission layer 216, and the focus electrode 218 together form a back-gate field emission cathode device 200.

The field emission display 20 is similar to the field emission display 10 except that the cathode electrode 212 further defines at least one sixth opening 2124 about the second opening 2122.

Figure 6:
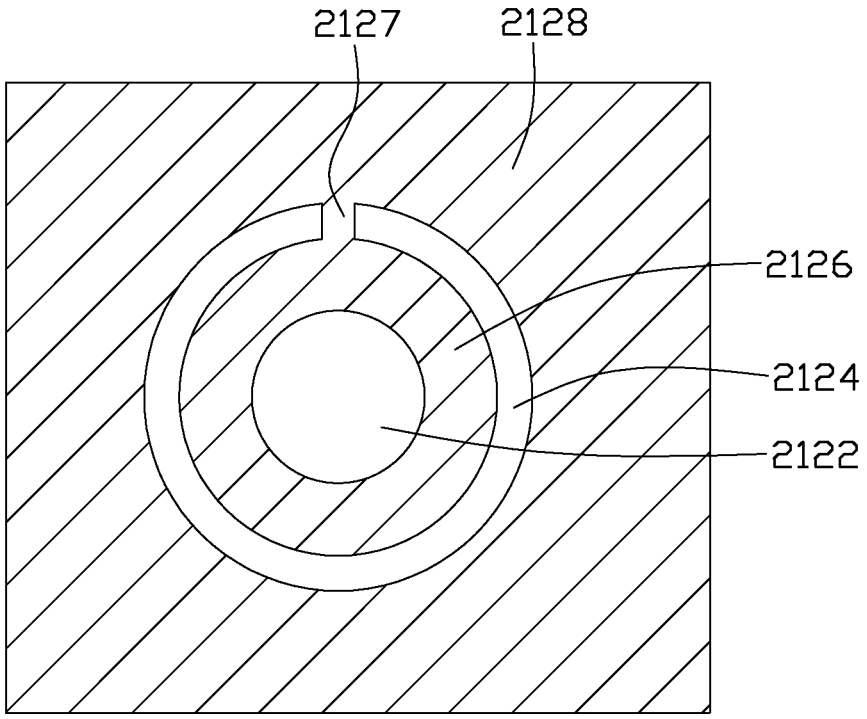
FIG. 6 shows a cathode and an electron emission layer of one embodiment of the field emission display of FIG. 5.
Figure 7:
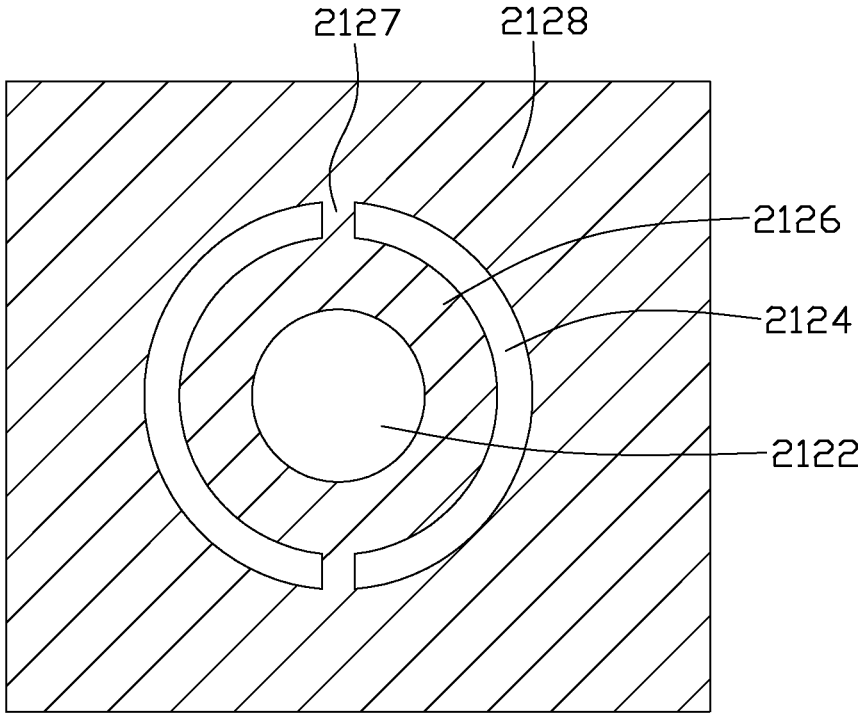
FIG. 7 shows a cathode and an electron emission layer of one embodiment of the field emission display of FIG. 5.
Figure 8:
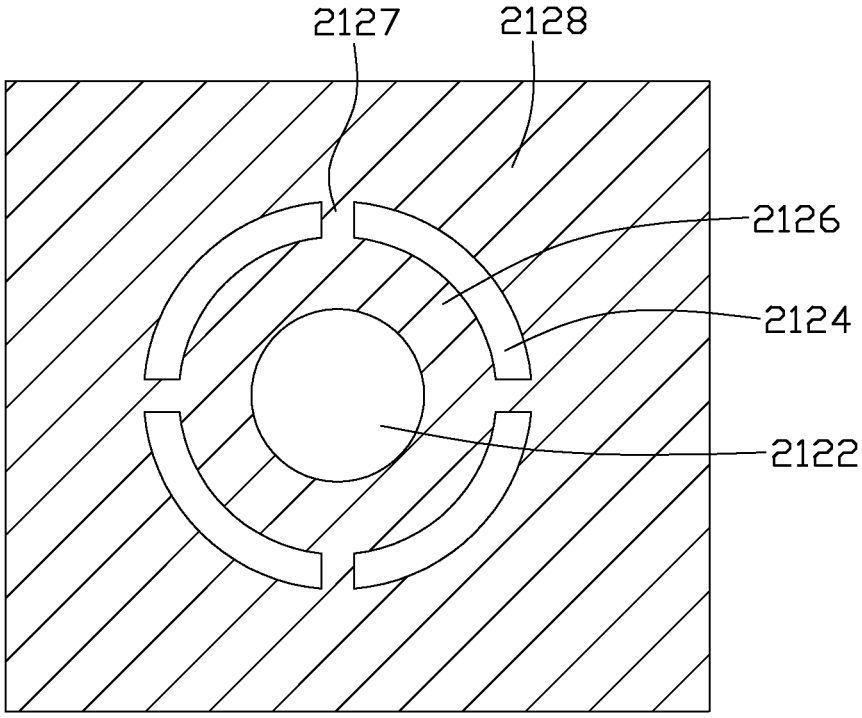
FIG. 8 shows a cathode and an electron emission layer of one embodiment of the field emission display of FIG. 5.

Further referring to FIGS. 6 to 8, the sixth opening 2124 substantially surrounds the second opening 2122. The sixth opening 2124 divides the cathode electrode 212 into a first portion 2128 and second portion 2126 spaced from the first portion 2128. The first portion 2128 is located between the first dielectric layer 210 and the second dielectric layer 214. The second portion 2126 is located between the first dielectric layer 210 and the electron emission layer 216. The electron emission layer 216 is located only on the second portion 2126. The second opening 2122 is defined by the second portion 2126. The first portion 2128 and the second portion 2126 are electrically connected by at least one connecting portion 2127. The shape and size of the sixth opening 2124 can be selected according to need. The second opening 2122 can be round. The sixth opening 2124 can be an annular opening with a cutout as shown in FIG. 6, two semicircular openings as shown in FIG. 7, or four arc-shaped openings as shown in FIG. 8. When the second opening 2122 is square, the sixth opening 2124 can be four stripe-shaped openings in parallel with the side of the second opening 2122. The inner diameter of the sixth opening 2124 can be greater than or equal to the outer diameter of the electron emission layer 216. The outer diameter of the sixth opening 2124 can be less than or equal to the inner diameter of the fourth opening 2182. The sixth opening 2124 allows the electric field of the gate electrode 208 can reach the surface of the electron emission layer 216 from the sixth opening 2124 to enhance the emission efficiency of the electron emission layer 216.

Furthermore, the first dielectric layer 210 can define at least one seventh opening 2104 corresponding to the sixth opening 2124. The seventh opening 2104 substantially surrounds the first opening 2102. Thus, the electrons, moving toward the gate electrode 208 and through the sixth opening 2124, will be captured by the gate electrode 208 and be conducted by the gate electrode 208.

The field emission display 10 has following advantages. First, the cathode electrode defines a second opening, the electron emission layer is located adjacent to the second opening, so the electric field of the gate electrode can reach the surface of the electron emission layer from the second opening to allow ring-shaped electron emission layer emit electron to form a uniform pixel unit images. Second, the first opening allows the electrons, moving toward the gate electrode, to be captured by the gate electrode and be conducted by the gate electrode that prevents the first dielectric layer from capturing electrons. Third, the secondary electron emission layer located on a surface of the gate electrode can enhance the emission efficiency of the field emission cathode device. Fourth, the cathode electrode defines at least one sixth opening about the second opening that allows the electric field of the gate electrode can reach the surface of the electron emission layer from the sixth opening to enhance the emission efficiency of the electron emission layer.

It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

What is claimed is:

1. A field emission cathode device, comprising:

a cathode substrate;

a gate electrode located on the cathode substrate;

a first dielectric layer located on the gate electrode and defining a first opening such a gate electrode exposed portion is exposed;

a cathode electrode located on the first dielectric layer and defining a second opening in alignment with the first opening and a sixth opening about the second opening, wherein the sixth opening divides the cathode electrode into a first portion, a second portion and at least one connecting portion; and the second portion is spaced from the first portion and electrically connected to the first portion by the at least one connecting portion; and an electron emission layer located on the cathode electrode, wherein the second portion is located between the first dielectric layer and the electron emission layer, and the electron emission layer is located only on the second portion.

2. The field emission cathode device of claim 1, wherein the electron emission layer defines a third opening in communication with the second opening.

3. The field emission cathode device of claim 2, wherein the third opening, the second opening and the first opening are coaxial and have the same diameter.

4. The field emission cathode device of claim 1, wherein the second opening is round, and the sixth opening is an annular opening with a cutout, two semicircular openings, or four arc-shaped openings.

5. The field emission cathode device of claim 1, wherein an inner diameter of the sixth opening is greater than or equal to an outer diameter of the electron emission layer.

6. The field emission cathode device of claim 1, wherein the first dielectric layer further defines a seventh opening corresponding to the sixth opening and surrounding the first opening.

7. The field emission cathode device of claim 1, further comprising a focus electrode spaced from the cathode electrode.

8. The field emission cathode device of claim 7, wherein the focus electrode defines a fourth opening having an inner diameter greater than an outer diameter of the sixth opening to expose the gate electrode.

9. The field emission cathode device of claim 7, wherein the cathode electrode has an exposed part defined by the fourth opening, and the electron emission layer is located only on the exposed part.

10. The field emission cathode device of claim 7, wherein the focus electrode is suspended above the cathode electrode.

11. The field emission cathode device of claim 7, further comprising a second dielectric layer located on the cathode electrode, and the focus electrode is located on the second dielectric layer.

12. The field emission cathode device of claim 11, wherein the electron emission layer is spaced from the second dielectric layer.

13. The field emission cathode device of claim 1, further comprising a secondary electron emission layer located on the gate electrode exposed portion.

14. A field emission cathode device, comprising:

a cathode substrate;

a gate electrode located on the cathode substrate;

a first dielectric layer located on the gate electrode and defining a first opening such that a gate electrode exposed portion is exposed;

a cathode electrode located on the first dielectric layer and defining a second opening in communication with the first opening; and an electron emission layer located on the cathode electrode;

wherein the cathode electrode further defines a sixth opening about the second opening, and the first dielectric layer further defines a seventh opening in communication with the sixth opening and about the first opening, wherein the sixth opening divides the cathode electrode into a first portion, a second portion and at least one connecting portion; the second portion is spaced from the first portion and electrically connected to the first portion by the at least one connecting portion; the second portion is located between the first dielectric layer and the electron emission layer; and the electron emission layer is located only on the second portion.

15. A field emission display, comprising:

a cathode substrate;

a plurality of gate electrodes located on the cathode substrate parallel and spaced from each other;

a plurality of cathode electrodes located in parallel with and spaced from each other, and vertical to the plurality of gate electrodes, wherein each intersection of the plurality of cathode electrodes and the plurality of gate electrodes defines a pixel unit;

a first dielectric layer located between the plurality of gate electrodes and the plurality of cathode electrodes, wherein a first opening is defined by the first dielectric layer and the plurality of cathode electrodes corresponding to each pixel unit, wherein in each pixel unit, the cathode electrode further defines a sixth opening about the first opening, the sixth opening divides the cathode electrode into a first portion, a second portion and at least one connecting portion; and the second portion is spaced from the first portion and electrically connected to the first portion by the at least one connecting portion;

a plurality of ring-shaped electron emission layers located on the plurality of cathode electrodes, wherein the second portion is located between the first dielectric layer and the plurality of ring-shaped electron emission layers, and each of the plurality of ring-shaped electron emission layers is located corresponding to each pixel unit and only on the second portion;

a second dielectric layer located on the plurality of cathode electrodes;

a focus electrode located on the second dielectric layer, wherein a second opening is defined by the focus electrode and the second dielectric layer corresponding to each pixel unit to expose the plurality of ring-shaped electron emission layers;

an anode substrate spaced from the cathode substrate to define a vacuum space;

an anode electrode located on the anode substrate and spaced from the cathode substrate; and a plurality of fluorescent layers located on the anode electrode, wherein each of the plurality of fluorescent layers corresponds to one of the plurality of ring-shaped electron emission layers.

16. The field emission display of claim 15, wherein an orthographic projection of the sixth opening is covered by an orthographic projection of the second opening.

* * * * *